US011607772B2

(12) United States Patent
Luescher et al.

(10) Patent No.: US 11,607,772 B2
(45) Date of Patent: Mar. 21, 2023

(54) QUICK CLAMPING DEVICE FOR AT LEAST ONE ROTATIONALLY DRIVABLE DRIVE SHAFT HAVING A PORTABLE MACHINE TOOL, IN PARTICULAR AN ANGLE GRINDING MACHINE

(71) Applicant: Robert Bosch GmbH, Stuttgart (DE)

(72) Inventors: Bruno Luescher, Vordemwald (CH); Andreas Zurbruegg, Lohn-Ammansegg (CH); David Winistoerfer, Kriegstetten (CH); Alexander Wuensche, Bad Schandau (DE); Marcus Schuller, Dettenhausen (DE)

(73) Assignee: Robert Bosch GmbH, Stuttgart (DE)

( * ) Notice: Subject to any disclaimer, the term of this patent is extended or adjusted under 35 U.S.C. 154(b) by 1014 days.

(21) Appl. No.: 16/341,432

(22) PCT Filed: Oct. 4, 2017

(86) PCT No.: PCT/EP2017/075111
§ 371 (c)(1),
(2) Date: Apr. 11, 2019

(87) PCT Pub. No.: WO2018/072996
PCT Pub. Date: Apr. 26, 2018

(65) Prior Publication Data

US 2019/0262970 A1 Aug. 29, 2019

(30) Foreign Application Priority Data

Oct. 18, 2016 (DE) ..... 10 2016 220 362.2

(51) Int. Cl.
*B24B 45/00* (2006.01)
*B24B 23/02* (2006.01)
*B27B 5/32* (2006.01)

(52) U.S. Cl.
CPC ..... *B24B 45/006* (2013.01); *B24B 23/02* (2013.01); *B24B 23/022* (2013.01);
(Continued)

(58) Field of Classification Search
CPC ..... B24B 23/02; B24B 23/022; B24B 23/028; B24B 23/04; B24B 45/00; B24B 45/006; B24B 55/00
(Continued)

(56) References Cited

U.S. PATENT DOCUMENTS 5,058,909 A * 10/1991 Rudolf ..... B24B 45/006 451/342
5,157,873 A 10/1992 Rudolf et al.
(Continued)

FOREIGN PATENT DOCUMENTS

CN 101890671 A 11/2010
CN 103909472 A 7/2014
(Continued)

OTHER PUBLICATIONS

International Search Report corresponding to PCT Application No. PCT/EP2017/075111, dated Oct. 4, 2017 (German and English language document) (5 pages).

*Primary Examiner* — Scott A Smith
(74) *Attorney, Agent, or Firm* — Maginot, Moore & Beck LLP

(57) ABSTRACT

A quick clamping device for a portable machine tool includes at least one drive shaft, at least one clamping unit, and at least one operating unit. The clamping unit has, for tool-less fastening of an insertion tool on the drive shaft, at least one clamping element for exerting a clamping force on the insertion tool in a clamping position. The operating unit is configured to move the clamping element into a release position, and includes at least one operating element, in
(Continued)

particular an operating lever. The operating element has at least one activation surface for movement of the clamping element into the release position. The activation surface is arranged such that at least one force initiation point of the operating element is movable, upon interaction with a contact surface of an actuating element of the operating unit, as a factor of movement of the operating element on the contact surface.

14 Claims, 4 Drawing Sheets

(52) U.S. Cl.
CPC ..... *B24B 23/028* (2013.01); *B24B 45/00* (2013.01); *B27B 5/32* (2013.01)

(58) Field of Classification Search
USPC ..... 173/29, 216, 217, 131, 171; 451/342, 451/344, 523, 359; 279/142
See application file for complete search history.

(56) References Cited

U.S. PATENT DOCUMENTS 5,158,331 A * 10/1992 Wesselski ..... F16B 2/185 294/94
5,601,483 A * 2/1997 Rudolf ..... B24B 23/022 451/344
6,569,001 B2 * 5/2003 Rudolf ..... B24B 45/006 451/523
7,856,724 B2 * 12/2010 Hartmann ..... B23Q 11/0092 188/74
8,317,574 B2 * 11/2012 Blickle ..... B27B 5/32 451/344
9,486,909 B2 * 11/2016 Zieger ..... B24B 23/022
9,545,699 B2 * 1/2017 Furusawa ..... B23Q 3/12
9,555,554 B2 * 1/2017 Thorson ..... B24B 23/04
10,682,736 B2 * 6/2020 Christophersen ..... B24B 55/00
10,946,544 B2 * 3/2021 Brown ..... B26D 7/2614
2002/0028644 A1 3/2002 Rudolf et al.
2002/0035882 A1 * 3/2002 Hartmann ..... B27B 5/32 30/388
2010/0236806 A1 9/2010 Heilig et al.
2014/0191481 A1 * 7/2014 Kawakami ..... B23D 61/006 279/142
2014/0327215 A1 11/2014 Thorson et al.

FOREIGN PATENT DOCUMENTS

CN 104379303 A 2/2015
DE 100 17 458 A1 10/2001
EP 1 180 416 A2 2/2002
EP 1 182 019 A1 2/2002
EP 2 230 047 A2 9/2010
JP 2002-126944 A 5/2002
JP 2007-533472 A 11/2007

* cited by examiner

QUICK CLAMPING DEVICE FOR AT LEAST ONE ROTATIONALLY DRIVABLE DRIVE SHAFT HAVING A PORTABLE MACHINE TOOL, IN PARTICULAR AN ANGLE GRINDING MACHINE

This application is a 35 U.S.C. § 371 National Stage Application of PCT/EP2017/075111, filed on Oct. 4, 2017, which claims the benefit of priority to Serial No. DE 10 2016 220 362.2, filed on Oct. 18, 2016 in Germany, the disclosures of which are incorporated herein by reference in their entirety.

BACKGROUND

DE 100 17 458 A1 has already disclosed a quick clamping device for a portable power tool, in particular angle grinder, which has at least one output shaft which can be driven in rotation, having at least one clamping unit which, for tool-free fixing of an insert tool unit to the output shaft, has at least one movably mounted clamping element for exertion of a clamping force on the insert tool unit in a clamping position of the clamping element, and having at least one operator control unit at least for moving the clamping element into a release position of the clamping element, which operator control unit has at least one movably mounted operator control element.

SUMMARY

The disclosure proceeds from a quick clamping device for a portable power tool, in particular angle grinder, which has at least one output shaft which can be driven in rotation, having at least one clamping unit which, for tool-free fixing of an insert tool unit to the output shaft, has at least one movably mounted clamping element for exertion of a clamping force on the insert tool unit in a clamping position of the clamping element, and having at least one operator control unit at least for moving the clamping element into a release position of the clamping element, which operator control unit has at least one movably mounted operator control element.

It is proposed that, for a movement of the clamping element into the release position, the operator control element has at least one actuating surface which is arranged such that at least one force introduction point of the operator control element during an interaction with a contact surface of a movably mounted actuating element of the operator control unit is movable on the contact surface in a manner dependent on a movement of the operator control element. During an interaction of the actuating surface of the operator control element and the contact surface of the actuating element, there is preferably linear contact between the actuating surface of the operator control element and the contact surface of the actuating element. The at least one force introduction point of the operator control element is preferably arranged on a contact line of the actuating surface of the operator control element. There is preferably linear contact between the actuating surface of the operator control element and the contact surface of the actuating element along the contact line of the actuating surface of the operator control element. It is however also conceivable that, during an interaction of the actuating surface of the operator control element and the contact surface of the actuating element, there is punctiform contact, wherein the punctiform contact occurs at the at least one force introduction point of the operator control element. The at least one force introduction point of the operator control element is preferably formed by a contact point of the actuating surface of the operator control element, which contact point is provided for bearing against the contact surface of the actuating element during an interaction of the actuating surface of the operator control element and the contact surface of the actuating element. "Provided" is to be understood in particular to mean specially programmed, configured and/or equipped. The statement that an element and/or a unit is provided for a particular function is to be understood in particular to mean that the element and/or the unit carry/carries out and/or perform/performs said particular function in at least one state of use and/or operation. "Movably mounted" is to be understood in particular to mean a mounting of an element and/or of a unit, wherein the element and/or the unit have/has a movement capability, in particular decoupled from an elastic deformation of the element and/or of the unit, along a movement axis of more than 5 mm, preferably of more than 10 mm and particularly preferably of more than 50 mm and/or about a movement axis along an angle range of more than 1°, preferably of more than 5° and particularly preferably of more than 15°.

The at least one force introduction point is movable on the contact surface, in a manner already known to a person skilled in the art, in a manner dependent on a movement of the operator control element and on an interaction of the actuating surface with the contact surface. The at least one force introduction point preferably differs from a fixed point of the actuating surface of the operator control element. A position of the at least one force introduction point on the actuating surface is preferably variable, in a manner already known to a person skilled in the art, in a manner dependent on a movement position of the operator control element and on an interaction of the actuating surface with the contact surface. The actuating surface of the operator control element, in particular the at least one force introduction point, preferably slides along the contact surface of the actuating element during an interaction of the actuating surface of the operator control element and the contact surface of the actuating element. The actuating surface of the operator control element is preferably arranged on an eccentric portion of the operator control element. The actuating surface of the operator control element is preferably designed as a domed outer surface of the operator control element. The operator control element preferably has, in the eccentric portion, a circular-arc-shaped outer contour, in particular in a plane running at least substantially perpendicular to a movement axis of the operator control element. The operator control element preferably has a maximum longitudinal extent of in particular less than 50 mm, preferably less than 40 mm and particularly preferably less than 30 mm. The maximum longitudinal extent of the operator control element runs preferably along a direction running at least substantially perpendicular to a movement axis of the operator control element.

The quick clamping device preferably comprises a decoupling unit which is provided for decoupling the operator control unit from the clamping unit in a manner dependent on a rotational speed of the output shaft. The decoupling unit is preferably provided for decoupling the operator control unit from the clamping unit in a manner dependent on a rotational speed of the output shaft, which is in particular higher than 100 rpm, preferably higher than 500 rpm, particularly preferably higher than 1000 rpm, and particularly preferably higher than 5000 rpm. In the case of a rotational speed of the output shaft of in particular less than 1000 rpm, preferably of less than 500 rpm and particularly preferably less than 100 rpm, the decoupling element is provided for coupling the operator control unit to the clamping unit, in particular in order to permit a movement of the clamping element by means of an action of an operator force imparted by the operator control unit. The decoupling unit is preferably provided for preventing and/or interrupting a transmission of an actuating force from the operator control unit to the clamping unit, and/or converting said actuating force into a movement of the decoupling element, in a manner dependent on a rotational speed of the output shaft. In particular, the decoupling element is provided for preventing and/or interrupting a force-transmitting connection between the operator control unit and the clamping unit in a manner dependent on a rotational speed of the output shaft. Preferably, the decoupling element is designed as a mechanical decoupling element. The decoupling unit is preferably provided for decoupling the operator control unit from the clamping unit, in a manner dependent on a rotational speed of the output shaft, owing to a relative movement between at least one element of the operator control unit and at least one element of the clamping unit and/or decoupling unit. The decoupling unit may have a clutch element, a centrifugal element, a friction element, or some other element that would appear expedient to a person skilled in the art, by means of which the operator control unit can be decoupled from the clamping unit in a manner dependent on a rotational speed of the output shaft. It is however also conceivable for the decoupling unit to be designed as an electric and/or electronic decoupling unit. For example, in the case of an embodiment of the decoupling unit as an electric and/or electronic decoupling unit, it is conceivable for a rotational speed of the output shaft to be electronically detectable, for example by means of at least one sensor element of the decoupling unit or by means of an electronic evaluation of drive unit characteristic variables, wherein a lock of the decoupling unit, which lock activates or deactivates an actuation of the operator control unit, can be actuated by means of an actuator of the decoupling unit in a manner dependent on a rotational speed of the output shaft, and/or wherein a clutch of the decoupling unit, which clutch opens or closes a force transmission connection between the operator control unit and the clamping unit, can be actuated by means of an actuator of the decoupling unit in a manner dependent on a rotational speed of the output shaft. Further embodiments of the decoupling unit that appear expedient to a person skilled in the art are likewise conceivable. The decoupling unit is preferably arranged at least partially on and/or in the output shaft. By means of the decoupling unit, it is preferably possible for a movement of the clamping element owing to an actuation of an operator control element of the operator control unit to be prevented in a manner dependent on a rotational speed of the output shaft.

The quick clamping device preferably comprises at least one securing unit, in particular a self-locking unit and/or a detent unit, which is provided for preventing a movement of the clamping element from the clamping position into the release position of the clamping element, in particular aside from tolerance-induced and/or play-induced movements of the clamping element, at least in the event of the clamping element being subjected to a force which is decoupled from the operator control unit and which acts in the direction of the release position of the clamping element. The securing unit, in particular the self-locking unit and/or the detent unit, is preferably provided for substantially securing the clamping element against a movement into the release position of the clamping element proceeding from the clamping position at least in the event of the clamping element being subjected to a force which is decoupled from the operator control unit and which acts in the direction of the release position of the clamping element. The expression "for substantially securing against a movement" is to be understood in particular to mean securing of an element, in particular in one position of the element, against a movement, wherein a tolerance-induced and/or play-induced movement of the element may occur in the secured position of the element. Preferably, in the secured position of the clamping element, a positive locking connection between the clamping element and the insert tool unit is secured, in particular in order to prevent an inadvertent release of the insert tool unit from the clamping unit. In the release position of the clamping element, the insert tool unit is preferably removable from the clamping unit and/or from the output shaft. The clamping element can preferably be secured in the clamping position, so as to be prevented from moving into the release position of the clamping element, by the securing unit by means of a positive locking and/or non-positive locking connection in the clamping position. The securing unit is preferably at least provided for at least substantially preventing a pivoting movement of the clamping element proceeding from the clamping position into the release position of the clamping element, in particular aside from a tolerance-induced and/or play-induced pivoting movement, so as to prevent a pivoting movement of the clamping element into the release position. The securing unit may be designed as a magnetic securing unit, as a mechanical securing unit, as an electronic securing unit or the like. In the case of the securing unit being designed as a magnetic securing unit, it is conceivable for the securing unit to comprise at least one magnet element which secures the clamping element in the clamping position by means of the action of a magnetic force. In the case of the securing unit being designed as a mechanical securing unit, it is conceivable for the securing unit to comprise at least one mechanical securing element which secures the clamping element in the clamping position by means of a positively locking and/or non-positively locking connection. In the case of the securing unit being designed as an electronic securing unit, it is conceivable for the securing unit to comprise at least one electronic element which secures the clamping element in the clamping position and/or which monitors a position of the clamping element and, when the clamping position is reached, activates an actuator which secures the clamping element in the clamping position. Further embodiments of the securing unit that appear expedient to a person skilled in the art are likewise conceivable.

The clamping element is preferably movable by means of the operator control unit into the clamping position and/or into the release position by means of a mechanical connection between at least the operator control element of the operator control unit and the clamping element. The operator control element is preferably designed as an operator control lever, in particular as a pivotably mounted operator control lever. It is however also conceivable that, by means of an operator control element of the operator control unit, an electrical signal can be generated by means of which an actuator can be activated, which actuator is provided for moving the clamping element into the clamping position and/or into the release position. The operator control unit may be designed as a mechanical, an electrical and/or an electronic operator control unit, which is provided for moving the clamping element into the clamping position and/or into the release position as a result of an operator control command from an operator and/or as a result of a force exerted by an operator. The clamping unit preferably comprises at least two movably, in particular pivotably, mounted clamping elements. It is however also conceivable for the clamping unit to comprise a number of clamping elements other than two. Preferably, the at least two clamping elements have an at least substantially analogous design. Preferably, the at least two clamping elements of the clamping unit are mounted so as to be movable relative to one another, in particular pivotable relative to one another. In particular, the at least two clamping elements are movable by means of the operator control unit into a clamping position of the clamping elements and/or into a release position of the clamping elements. Preferably, the at least two clamping elements are movable jointly, in particular movable jointly into the clamping position and/or into the release position, by means of the operator control unit. It is however also conceivable for the at least two clamping elements to be movable independently of one another into the clamping position and/or into the release position by means of the operator control unit.

The clamping element is preferably arranged at least partially in the output shaft. It is preferable for the output shaft to at least partially, in particular completely, surround the clamping element along a circumferential direction running around an axis of rotation of the output shaft. The clamping element is preferably connected rotationally conjointly to the output shaft. The clamping element is preferably mounted so as to be pivotable about a pivot axis of the clamping element. The pivot axis of the clamping element preferably runs transversely, in particular at least substantially perpendicularly, with respect to the axis of rotation of the output shaft. The pivot axis of the clamping element preferably runs at least substantially perpendicular to a clamping axis of the clamping unit. Here, a "clamping axis" to be understood in particular to mean an axis of the clamping unit along which an axial securing force of the clamping unit can be exerted on the insert tool unit in order to fix the insert tool unit on the output shaft and/or along which a transmission element of the clamping unit is mounted so as to be movable for a movement of the clamping element. "At least substantially perpendicular" is to be understood in particular to mean an orientation of a direction relative to a reference direction, wherein the direction and the reference direction, viewed in particular in one plane, enclose an angle of 90°, and the angle has a maximum deviation of in particular less than 8°, advantageously less than 5° and particularly advantageously less than 2°. The clamping element is preferably formed as a clamping jaw. The clamping element is preferably provided for securing the insert tool unit axially on the output shaft. Preferably, the clamping element, at least in the clamping position, engages at least partially into the insert tool unit, in particular into a fixing recess of the insert tool unit. Preferably, at least in a state in which the insert tool unit is fixed by means of the clamping unit, the clamping element engages behind a clamping projection of the insert tool unit. By means of the embodiment according to the disclosure of the quick clamping device, it is advantageously possible to realize a high level of operator convenience. It is advantageously possible, owing to a movement of the at least one force introduction point on the contact surface, to realize a change in a lever arm for a movement of the actuating element in a manner dependent on a movement of the operator control element. It is advantageously possible to realize a low actuating force for an actuation of the operator control element designed as operator control lever.

It is also proposed that the operator control element has a movement axis, in particular a pivot axis, which is arranged so as to be offset, in particular skewed, relative to a movement axis of the actuating element. The movement axis of the operator control element preferably runs at least substantially perpendicular to a movement axis of the actuating element, as viewed in a projection plane into which the movement axis of the operator control element and the movement axis of the actuating element are projected. The movement axis of the actuating element runs preferably at least substantially parallel, in particular coaxially, with respect to the clamping axis of the clamping unit and/or with respect to the axis of rotation of the output shaft. The actuating element is preferably mounted so as to be movable in translational fashion along the movement axis of the actuating element. The actuating element is preferably designed as an actuating bolt. By means of the embodiment according to the disclosure of the quick clamping device, it is advantageously possible to realize a high level of operator convenience. It is advantageously possible, owing to a movement of the at least one force introduction point on the contact surface, to realize a change in a lever arm for a movement of the actuating element in a manner dependent on a movement of the operator control element. It is advantageously possible to realize a low actuating force for an actuation of the operator control element designed as operator control lever. It is possible in a simple manner in terms of construction for a movement of the at least one force introduction point on the contact surface of the actuating element to be realized during an interaction of the actuating surface of the operator control element and the contact surface of the actuating element.

It is also proposed that the operator control element has a movement axis, in particular a pivot axis, wherein a straight line running through the movement axis of the operator control element and the force introduction point encloses an angle in an angle range from 35° to 85°, in a plane running at least substantially perpendicular to the movement axis of the operator control element, with the contact surface of the actuating element in a manner dependent on an actuation position of the operator control element. Preferably, in an actuating position of the operator control element, in which the operator control element has been moved from a rest position of the operator control element into a contact position of the operator control element, the straight line running through the movement axis and the force introduction point encloses an angle of less than 50° and greater than 35°, in particular an angle with a value of 40°, with a contact surface of the actuating element. In the contact position of the operator control element, the actuating surface preferably bears against the contact surface, wherein the actuating element has not been moved along the movement axis of the actuating element. Preferably, in an actuating position of the operator control element, in which the operator control element has been moved from the rest position or from the contact position into an end position of the operator control element, the straight line running through the movement axis and the force introduction point encloses an angle of less than 90° and greater than 70°, in particular an angle with a value of 80°, with the contact surface of the actuating element. In the end position of the operator control element, the actuating surface preferably bears against the contact surface, wherein the actuating element has been moved along the movement axis of the actuating element to a maximum extent by means of the operator control element. The operator control element preferably has a maximum movement angle of 90° from the rest position into the end position. The operator control element covers the maximum level travel angle preferably during a movement from the rest position into the contact position. In the rest position, the operator control element preferably bears with a stop region against a gearing housing of the portable power tool. The stop region of the operator control element is preferably arranged on a side of the operator control element which is averted from the eccentric portion. By means of the embodiment according to the disclosure of the quick clamping device, it is advantageously possible to realize a high level of operator convenience. It is advantageously possible, owing to a movement of the at least one force introduction point on the contact surface, to realize a change in a lever arm for a movement of the actuating element in a manner dependent on a movement of the operator control element. It is advantageously possible to realize a low actuating force for an actuation of the operator control element designed as operator control lever. It is advantageously possible to permit a compact design of the operator control unit.

It is also proposed that the force introduction point is movable along a straight line on the contact surface owing to a movement of the operator control element. The force introduction point is preferably movable along a straight line on the contact surface owing to a movement of the operator control element from the contact position of the operator control element into the end position of the operator control element. Preferably, the actuating element is moved in translational fashion along the movement axis of the actuating element, in particular for a movement of the clamping element from the clamping position of the clamping element into the release position of the clamping element, owing to a movement of the operator control element from the contact position of the operator control element into the end position of the operator control element. By means of the embodiment according to the disclosure of the quick clamping device, it is advantageously possible to realize a high level of operator convenience. It is advantageously possible, owing to a movement of the at least one force introduction point on the contact surface, to realize a change in a lever arm for a movement of the actuating element in a manner dependent on a movement of the operator control element. It is advantageously possible to realize a low actuating force for an actuation of the operator control element designed as operator control lever.

It is also proposed that the force introduction point is movable along a straight line on the contact surface at least substantially over a maximum extent of the contact surface owing to a movement of the operator control element. The force introduction point is preferably movable along a straight line on the contact surface at least substantially over a maximum extent of the contact surface owing to a movement of the operator control element from the contact position of the operator control element into the end position of the operator control element. The force introduction point is preferably movable from one edge of the contact surface to a further edge of the contact surface, which is averted from the edge of the contact surface, owing to a movement of the operator control element. The force introduction point is preferably movable within an end surface of the actuating element. The end surface of the actuating element, which faces toward the operator control element, preferably forms the contact surface of the actuating element. By means of the embodiment according to the disclosure of the quick clamping device, it is advantageously possible to realize a high level of operator convenience. It is advantageously possible, owing to a movement of the at least one force introduction point on the contact surface, to realize a change in a lever arm for a movement of the actuating element in a manner dependent on a movement of the operator control element. It is advantageously possible to realize a low actuating force for an actuation of the operator control element designed as operator control lever. It is advantageously possible to realize an advantageous transmission of force between the operator control element and the actuating element.

It is also proposed that the operator control element is mounted in pivotable fashion and has a minimum idle travel angle of greater than 5°. The operator control element preferably has a maximum idle travel angle of less than 20°, in particular of 18°. An "idle travel angle" is to be understood in particular to mean an angle covered by the operator control element during a movement from the rest position into the contact position. The operator control element is preferably movable without making contact with the actuating element during a movement from the rest position into the contact position. By means of the embodiment according to the disclosure of the quick clamping device, it is advantageously possible to realize a high level of operator convenience. It is advantageously possible, owing to a movement of the at least one force introduction point on the contact surface, to realize a change in a lever arm for a movement of the actuating element in a manner dependent on a movement of the operator control element. It is advantageously possible to realize a low actuating force for an actuation of the operator control element designed as operator control lever. It is advantageously possible to permit a convenient movement of the operator control element from the rest position into the contact position, which can be achieved with a low force exerted by an operator.

It is also proposed that the operator control element has at least one stop surface which limits a maximum movement, in particular a maximum travel angle, of the operator control element and is arranged adjacent to the actuating surface on the operator control element. The stop surface is preferably provided for limiting a maximum movement of the operator control element by means of an interaction with a stop element, arranged on the gearing housing of the portable power tool, of the operator control unit. The actuating surface of the operator control element preferably at least partially forms the stop surface of the operator control element. By means of the embodiment according to the disclosure of the quick clamping device, it is advantageously possible to realize a high level of operator convenience. It is advantageously possible, owing to a movement of the at least one force introduction point on the contact surface, to realize a change in a lever arm for a movement of the actuating element in a manner dependent on a movement of the operator control element. A maximum movement of the operator control element can be limited in a simple manner in terms of construction.

It is also proposed that the operator control element has a movement axis, in particular a pivot axis, and has at least two operator control surfaces which are arranged on mutually averted sides of the operator control element along a direction running at least substantially perpendicular to the movement axis of the operator control element. Preferably, at least one of the at least two operator control surfaces is provided for causing a movement of the operator control unit from the rest position into the contact position, in particular owing to a pressure force being exerted by a user on the at least one of the at least two operator control surfaces. Preferably, at least one of the at least two operator control surfaces is provided for causing a movement of the operator control element from the contact position into the end position, in particular owing to a pressure force being exerted by an operator on the at least one of the at least two operator control surfaces. By means of the embodiment according to the disclosure of the quick clamping device, it is advantageously possible to realize a high level of operator convenience. It is advantageously possible, owing to a movement of the at least one force introduction point on the contact surface, to realize a change in a lever arm for a movement of the actuating element in a manner dependent on a movement of the operator control element. It is advantageously possible to realize a low actuating force for an actuation of the operator control element designed as operator control lever.

Also proposed is a portable power tool, in particular an angle grinder, having a quick clamping device according to the disclosure. Here, a "portable power tool" is to be understood in particular to mean a power tool for machining workpieces, which power tool can be transported by an operator without using a transport machine. The portable power tool has in particular a mass of less than 40 kg, preferably less than 10 kg and particularly preferably less than 5 kg. The portable power tool is particularly preferably designed as an angle grinder. It is however also conceivable for the portable power tool to be of some other design that appears expedient to a person skilled in the art, for example designed as a circular saw, as a grinder or the like. The portable power tool preferably comprises an output shaft that can be driven in rotation. The quick clamping device is preferably arranged on the output shaft. The quick clamping device is preferably arranged at least partially in the output shaft. The output shaft is preferably designed as a hollow shaft. In particular, the portable power tool forms a power tool system together with an insert tool unit that can be fixed by means of the quick clamping device to the output shaft. By means of the embodiment according to the disclosure of the quick clamping device, it is advantageously possible to realize a high level of operator convenience. It is advantageously possible, owing to a movement of the at least one force introduction point on the contact surface, to realize a change in a lever arm for a movement of the actuating element in a manner dependent on a movement of the operator control element. It is advantageously possible to realize a low actuating force for an actuation of the operator control element designed as operator control lever.

It is also proposed that the portable power tool comprises at least one gearing housing on which the operator control element is movably mounted and is arranged in the vicinity of at least one ventilation opening of the gearing housing, wherein the operator control element, at least in a non-actuated state, is arranged on the gearing housing so as to at least substantially not overlap the ventilation opening. Preferably, at least in the rest position of the operator control element, the operator control element is arranged on the gearing housing so as not overlap the ventilation opening. A "vicinity" is to be understood in particular to mean a region which has a maximum spacing of in particular less than 100 mm, preferably less than 50 mm and particularly preferably less than 20 mm relative to an element and/or relative to a unit. By means of the embodiment according to the disclosure of the quick clamping device, it is advantageously possible to realize a high level of operator convenience. It is advantageously possible to realize a compact arrangement of the operator control unit on the portable power tool.

Here, it is not the intention for the quick clamping device according to the disclosure and/or the portable power tool according to the disclosure to be restricted to the use and embodiment described above. In particular, the quick clamping device according to the disclosure and/or the portable power tool according to the disclosure may, in order to perform a function described herein, have a number of individual elements, components and units and method steps that deviates from a number stated herein. Furthermore, where value ranges are stated in this disclosure, it is also the intention for values lying within the stated limits to be disclosed and usable as desired.

BRIEF DESCRIPTION OF THE DRAWINGS

Further advantages will emerge from the following description of the drawing. The drawing illustrates an exemplary embodiment of the disclosure. The drawing, the description and the claims contain numerous features in combination. A person skilled in the art will expediently also consider the features individually and combine them to form meaningful further combinations.

In the drawing.

DETAILED DESCRIPTION

Figure 1:
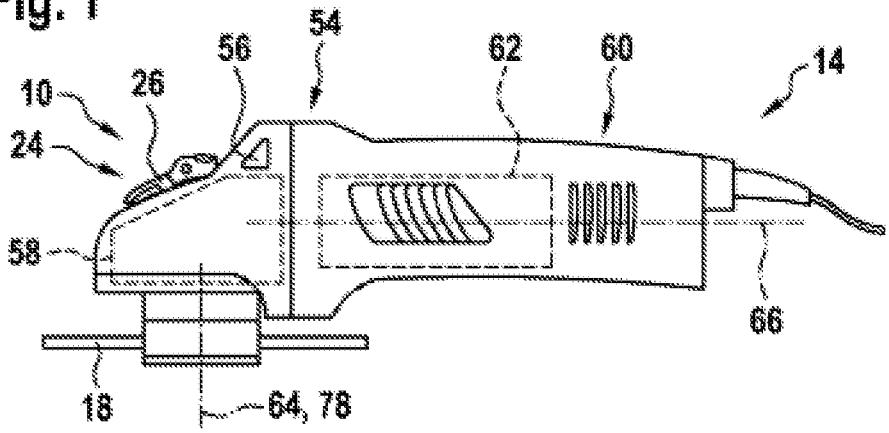
FIG. 1 shows a portable power tool according to the disclosure having a quick clamping device according to the disclosure in a schematic illustration.
Figure 2:
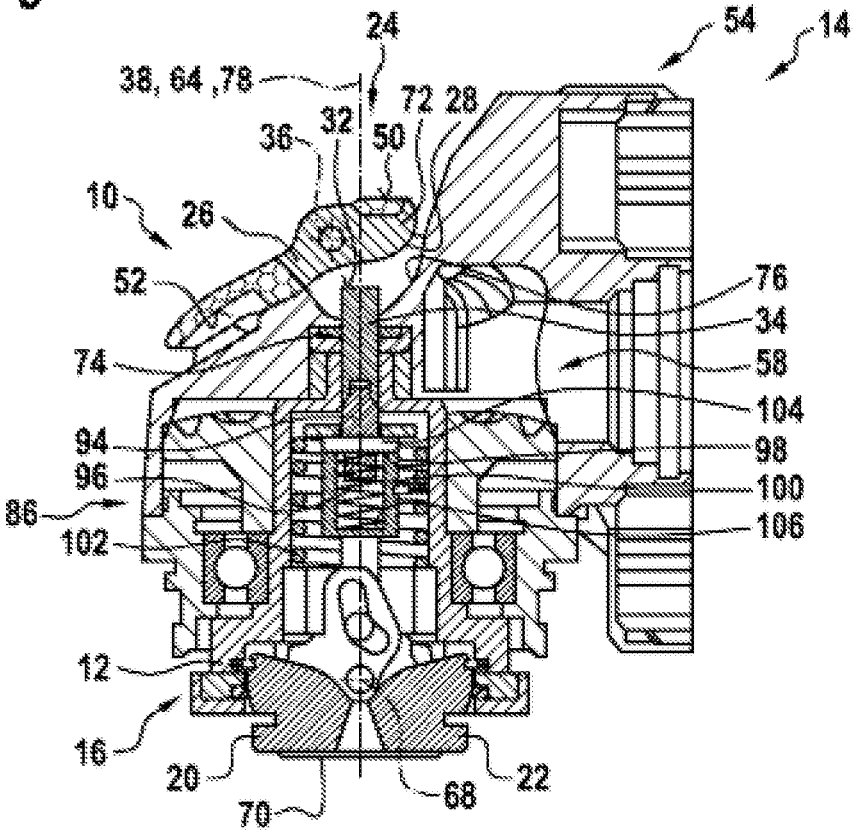
FIG. 2 shows a sectional view of the portable power tool according to the disclosure and of the quick clamping device according to the disclosure in a schematic illustration.

FIG. 1 shows a portable power tool 14 which is designed as an angle grinder and which has a quick clamping device 10. It is however also conceivable for the portable power tool 14 to be of some other design that appears expedient to a person skilled in the art, for example designed as a circular saw, as a grinder or the like. The portable power tool 14 comprises a gearing housing 54 for accommodating and/or for the mounting of a gearing unit 58 of the portable power tool 14. The gearing housing 54 is preferably formed from a metallic material. It is however also conceivable for the gearing housing 54 to be formed from some other material that appears expedient to a person skilled in the art, for example from plastic or the like. The gearing unit 58 is preferably designed as an angle gearing. The gearing unit 58 comprises in particular an output shaft 12 which can be driven in rotation and to which an insert tool unit 18 can be fixed, in particular by means of the quick clamping device 10. The output shaft 12 is preferably designed as a hollow spindle, in which the quick clamping device 10 is at least partially arranged (FIG. 2). A protective cover unit (not illustrated in any more detail here) can be arranged, in a manner already known to a person skilled in the art, on the gearing housing 54. An auxiliary handle (not illustrated in any more detail here) can be arranged, in a manner already known to a person skilled in the art, on the gearing housing 54. The portable power tool 14 comprises a motor housing 60 for accommodating and/or for the mounting of a drive unit 62 of the portable power tool 14. The drive unit 62 is preferably provided, in a manner already known to a person skilled in the art, for driving the output shaft 12 in rotation about an axis of rotation 64 of the output shaft 12 by interaction with the gearing unit 58. The axis of rotation 64 of the output shaft 12 runs at least substantially perpendicular to a drive axis 66 of the drive unit 62. The drive unit 62 is preferably designed as an electric motor unit. It is however also conceivable for the drive unit 62 to be of some other design that appears expedient to a person skilled in the art, for example designed as a combustion-type drive unit, as a hybrid drive unit, as a pneumatic drive unit or the like.

FIG. 2 shows a sectional view of the portable power tool 14, in particular in the region of the gearing housing 54, and of the quick clamping device 10. The quick clamping device 10 for the portable power tool 14, which has at least the output shaft 12 that can be driven in rotation, comprises at least one clamping unit 16, which, for tool-free fixing of the insert tool unit 18 to the output shaft 12, has at least one movably mounted clamping element 20, 22 for the action of a clamping force on the insert tool unit 18 in a clamping position of the clamping element 20, 22. Furthermore, the quick clamping device 10 comprises at least one operator control unit 24 at least for moving the clamping element 20, 22 into a release position of the clamping element 20, 22, which operator control unit has at least one movably mounted operator control element 26, in particular a movably mounted operator control lever. The clamping unit 16 comprises at least two movably mounted clamping elements 20, 22. It is however also conceivable for the clamping unit 16 to comprise a number of clamping elements 20, 22 other than two. The at least two clamping elements 20, 22 have an at least substantially analogous design, such that features disclosed with regard to one of the clamping elements 20, 22 are to be regarded as likewise disclosed for the further clamping element 20, 22. The at least two clamping elements 20, 22 are pivotably mounted. A pivot axis 68 of the clamping elements 20, 22, in particular of the at least two clamping elements 20, 22, runs at least substantially perpendicular to the axis of rotation 64 of the output shaft 12. The at least two clamping elements 20, 22 are provided for fixing the insert tool unit 18, in a state in which it is arranged on the clamping unit 16 and/or the output shaft 12, axially on the output shaft 12, in particular in the clamping position of the at least two clamping elements 20, 22. The at least two clamping elements 20, 22 are connected rotationally conjointly to the output shaft 12. The at least two clamping elements 20, 22 can be driven in rotation about the axis of rotation 64 together with the output shaft 12.

The clamping unit 16 comprises, for a transmission of torque to the insert tool unit 18, at least one rotary driving element 70. In a state in which the insert tool unit 18 is arranged on the clamping unit 16 and/or the output shaft 12, the rotary driving element 70 engages into a receiving recess (not illustrated in any more detail here) of the insert tool unit 18 and, for a transmission of torque, bears against at least one edge, which delimits the receiving recess, of the insert tool unit 18. A transmission of torque between the output shaft 12 and the insert tool unit 18 arranged on the clamping unit 16 and/or the output shaft 12 is preferably realized, in a manner already known to a person skilled in the art, by means of a positive locking connection between the rotary driving element 70 and the insert tool unit 18. The rotary driving element 70 is arranged rotationally conjointly on the output shaft 12. The rotary driving element 70 can be driven in rotation about the axis of rotation 64 together with the output shaft 12.

The operator control unit 24 is preferably provided for moving the clamping element 20, 22, in particular the at least two clamping elements 20, 22, at least into the release position, in which the insert tool unit 18 is removable from the clamping unit 16 and/or from the output shaft 12. Alternatively or in addition, it is conceivable for the operator control unit 24 to be provided for moving the clamping element 20, 22, in particular the at least two clamping elements 20, 22, at least into the clamping position, in which the insert tool unit 18 is fixable by means of the clamping unit 16 to the output shaft 12. The operator control unit 24 preferably comprises at least the operator control element 26, which is actuatable by an operator. The operator control element 26 is designed as an operator control lever. The operator control element 26 comprises a movement axis 36, in particular a pivot axis, which runs transversely, in particular at least substantially perpendicularly, with respect to the axis of rotation 64 of the output shaft 12. The operator control element 26 is preferably mounted so as to be pivotable about the movement axis 36, in particular pivot axis, of the operator control element 26. The operator control element 26 is decoupled from a rotational movement of the output shaft 12. The operator control element 26 is mounted movably on the gearing housing 54 and is arranged in the vicinity of at least one ventilation opening 56 of the gearing housing 54, wherein the operator control element 26 is, at least in a non-actuated state, in particular in a rest position of the operator control element 26, arranged on the gearing housing 54 so as to at least substantially not overlap the ventilation opening. The operator control element 26 is movable partially into a recess 76 of the gearing housing 54. An actuating element 34 of the operator control unit 24, which is actuatable and/or movable by means of the operator control element 26, extends at least partially into the recess 76. For cleaning of the recess 76, it is conceivable for dirt to be able to be at least partially conveyed out of the recess 76 by means of an eccentric portion 72 of the operator control element 26 owing to a movement of the operator control element 26 about a movement axis 36 of the operator control element 26. It is conceivable for the operator control element 26 to have at least one brush element which is arranged on the eccentric portion 72 and which is provided for sweeping out the recess 76 owing to a movement of the operator control element 26. It is also conceivable for the at least one ventilation opening 56 to be arranged on the gearing housing 54 such that an air stream emerging from the ventilation opening 56 can be utilized for cleaning the recess 76.

The clamping element 20, 22, in particular the clamping elements 20, 22, is/are mounted movably, in particular pivotably, on the output shaft 12, in particular in the output shaft 12. The pivot axis 68 of the clamping element 20, 22, in particular of the clamping elements 20, 22, runs preferably at least substantially perpendicular to the clamping axis 78 of the clamping unit 16*a*. The clamping element 20, 22, in particular the clamping elements 20, 22, has/have at least one motion slotted-guide element which is provided for interacting with a slotted-guide engagement element of the clamping unit 16. The slotted-guide engagement element is fixed to a transmission element 100 of the clamping unit 16. The slotted-guide engagement element is designed as a bolt which is fixed to the transmission element 100, in particular between two fork ends of the transmission element 100.

Owing to an interaction of the slotted-guide engagement element and of the motion slotted-guide element, the clamping element 20, 22, in particular the clamping elements 20, 22, is/are movable from the clamping position into the release position or from the release position into the clamping position. The clamping element 20, 22, in particular the clamping elements 20, 22, is/are in particular movable from the release position into the clamping position by means of an action of a spring force of a clamping spring element 102 of the clamping unit 16 on the transmission element 100. The clamping element 20, 22, in particular the clamping elements 20, 22, is/are movable into the clamping position automatically, in particular after withdrawal of an action of a force exerted by an operator by means of the operator control unit 24, owing to an action of a spring force of the clamping spring element 102.

The quick clamping device 10 comprises at least one decoupling unit 86 which is provided for decoupling the operator control unit 24 from the clamping unit 16 in a manner dependent on a rotational speed of the output shaft 12. The decoupling unit 86 is designed such that a relative movement occurs between at least one decoupling element 94 of the decoupling unit 86 and at least the actuating element 34 of the operator control unit 24, for the purposes of decoupling of the operator control unit 24 from the clamping unit 16, in a manner dependent on a rotational speed of the output shaft 12. The decoupling unit 86 comprises at least the movably mounted decoupling element 94 which can be transferred into a decoupling position, in which the operator control unit 24 is decoupled from the clamping unit 16, in a manner dependent on a rotational speed of the output shaft 12. The decoupling unit 86 is preferably designed as a friction-type decoupling unit. The decoupling unit 86 has at least the movably mounted decoupling element 94, which is movable relative to the output shaft 12 owing to a friction force between the decoupling element 94 and the actuating element 34 of the operator control unit 24. The decoupling unit 86 has at least the movably mounted decoupling element 94, which is mounted in the output shaft 12 so as to be movable along and/or around the axis of rotation 64 of the output shaft 12. The decoupling unit 86 comprises at least the movably mounted decoupling element 94 and at least one decoupling spring element 96, which acts on the decoupling element 94 with a spring force in the direction of the operator control unit 24. The decoupling unit 86 has at least the movably mounted decoupling element 94 and at least one slotted-guide element 98 for guiding the decoupling element 94 during a relative movement of the decoupling element 94 with respect to the output shaft 12.

The decoupling element 94 can be placed in contact with the actuating element 34 by means of a non-positively locking connection, or the decoupling element 94 is in contact with the actuating element 34 by means of a non-positively locking connection. The decoupling element 94 is preferably mounted, in particular in the output shaft or in the transmission element 100 of the clamping unit 16, so as to be movable in translational fashion along the axis of rotation 64. The decoupling element 94 comprises in particular a conical connection region which engages at least partially into a recess of the actuating element 34. A friction action between the actuating element 34 and the decoupling element 94 is in particular dependent on a design of the conical connecting region and on a spring force of the decoupling spring element 96. The decoupling spring element 96 is provided for acting on the decoupling element 94 with a spring force in the direction of the actuating element 34. The decoupling spring element 96 is arranged in the transmission element 100 of the clamping unit 16. The transmission element 100 is designed as a clamping fork. The transmission element 100 is connected rotationally conjointly to the output element 12. The transmission element 100 is movable in translational fashion along a clamping axis 78 of the clamping unit 16. The transmission element 100 is mounted movably in the output shaft 12. The transmission element 100 can, at least by means of a clamping spring element 102 of the clamping unit 16, be acted on with a spring force along the clamping axis 78, in particular in the direction of the operator control unit 24.

The decoupling unit 86 has at least one connecting element 104 which is provided for connecting the decoupling element 94 and the transmission element 100 to one another in terms of movement, in particular at least in a state of the output shaft 12 at a low rotational speed or when the output shaft 12 is at a standstill. The connecting element 104 is designed as a bolt. The connecting element 104 is arranged on, in particular fixed to, the decoupling element 94. The connecting element 104 is movable together with the decoupling element 94. The connecting element 104 extends into the slotted-guide element 98 of the decoupling unit 86 (FIG. 2). The slotted-guide element 98 is designed as a slotted-guide track. The slotted-guide element 98 is arranged on the transmission element 100, in particular is formed integrally with the transmission element 100. During a rotational movement of the output shaft 12, the decoupling element 94 and the connecting element 104 are rotatable relative to the transmission element 100 owing to a braking action resulting from an actuation of the actuating element 34, wherein the connecting element 104 is movable in the slotted guide element 98, formed as slotted-guide track, such that the decoupling element 94 is movable counter to a spring force of the decoupling spring element 96 into a guide recess 106 of the transmission element 100. An actuation of the operator control element 26 during a rotational movement of the output shaft 12 can be converted into a movement of the actuating element 34 and of the decoupling element 94 relative to the transmission element 100. A movement of the transmission element 100 resulting from an action of a force exerted by an operator by means of the operator control unit 24 for the purposes of transferring the clamping element 20, 22, in particular the clamping elements 20, 22, from the clamping position into the release position can be substantially prevented during a rotational movement of the output shaft 12. When the output shaft 12 is at a low rotational speed or when the output shaft 12 is at a standstill, an axial force exerted by the actuating element 34 on the decoupling element 94 can be transmitted to the transmission element 100 by means of an interaction of the connecting element 104 and the slotted-guide element 98 designed as slotted-guide track. The transmission element 100 is movable by means of the operator control unit 24 counter to a spring force of the clamping spring element 102. The transmission element 100 is provided for moving the clamping element 20, 22, in particular the clamping elements 20, 22, from the clamping position into the release position.

The operator control element 26 comprises the eccentric portion 72 for an actuation of the actuating element 34 of the operator control unit 24. The actuating element 34 is mounted so as to be movable in translational fashion along the axis of rotation 64, in particular in the output shaft 12 and/or in the gearing housing 54. The actuating element 34 is fixed in the gearing housing 54 so as to be prevented from rotating relative to the gearing housing 54, in particular owing to at least one lateral flattened portion of the actuating element 34, which permits an axial movement and prevents a rotational movement. Preferably, the actuating element 34 has in each case at least one flattened portion at two mutually averted sides of the actuating element 34. It is however also conceivable for the actuating element 34 to be of some other design that appears expedient to a person skilled in the art, for example to have a polygonal cross section, a toothing or the like, which is provided for securing the actuating element 34 against rotation relative to the gearing housing 54. In the region of the actuating element 34, there is preferably arranged a seal element 74, for example a rubber seal or the like, in particular for at least substantially preventing an ingress of dirt into the gearing housing 54 and/or into the clamping unit 16. The seal element 74 preferably bears against the actuating element 34. The actuating element 34 is in particular mounted so as to be movable relative to the seal element 74. The actuating element 34 slides on at least one sealing surface of the seal element 74 during a movement relative to the seal element 74.

Figure 3:
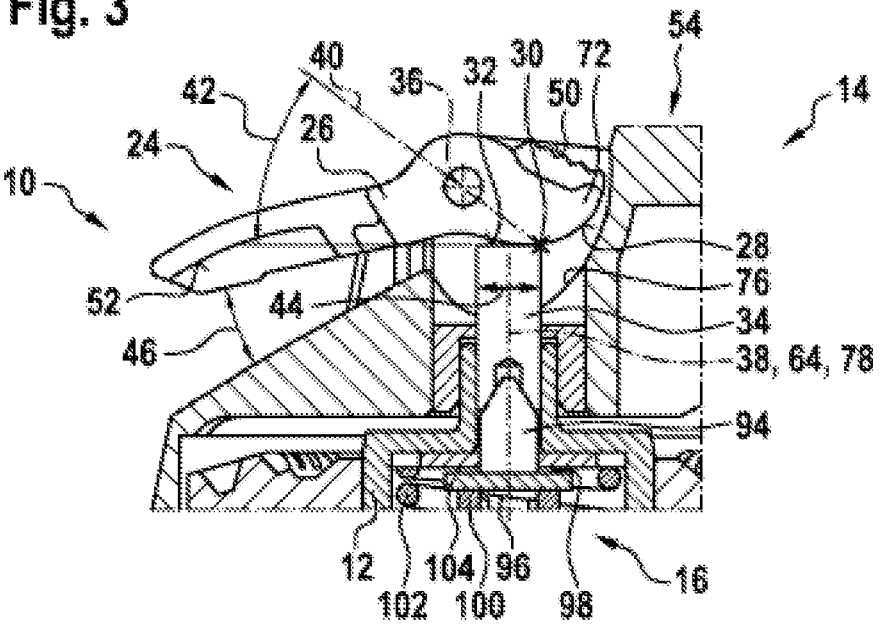
FIG. 3 shows a detail view of an operator control unit of the quick clamping device according to the disclosure, wherein an operator control element is arranged in a contact position of the operator control element, in a schematic illustration.
Figure 4:
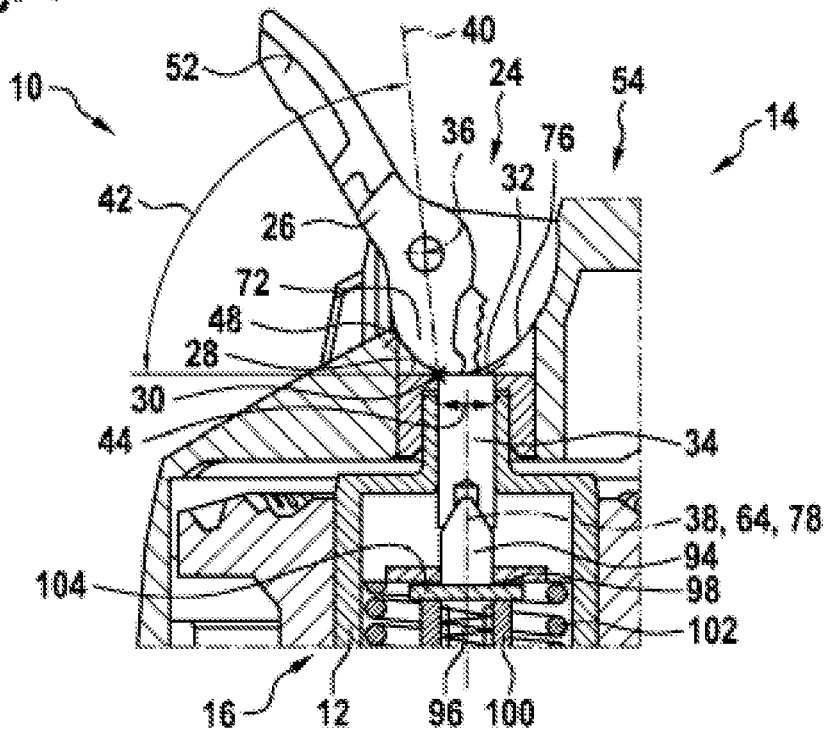
FIG. 4 shows a detail view of an operator control unit of the quick clamping device according to the disclosure, wherein an operator control element is arranged in an end position of the operator control element, in a schematic illustration.

For a movement of the clamping element 20, 22, in particular of the clamping elements 20, 22, into the release position, the operator control element 26 has at least one actuating surface 28 which is arranged such that at least one force introduction point 30 of the operator control element 26 during an interaction with a contact surface 32 of a movably mounted actuating element of the operator control unit 24 is movable on the contact surface 32 in a manner dependent on a movement of the operator control element 26 (cf. FIGS. 3 and 4). The actuating surface 28 of the operator control element 26 is preferably arranged on an eccentric portion 72 of the operator control element 26. During an interaction of the actuating surface 28 of the operator control element 26 and the contact surface 32 of the actuating element 34, there is preferably linear contact between the actuating surface 28 of the operator control element 26 and the contact surface 32 of the actuating element 34. The at least one force introduction point 30 of the operator control element 26 is preferably arranged on a contact line of the actuating surface 28 of the operator control element 26. There is preferably linear contact between the actuating surface 28 of the operator control element 26 and the contact surface 32 of the actuating element 34 along the contact line of the actuating surface 28 of the operator control element 26 during an interaction of the actuating surface 28 of the operator control element 26 and the contact surface 32 of the actuating element 34. It is however also conceivable that, during an interaction of the actuating surface 28 of the operator control element 26 and the contact surface 32 of the actuating element 34, there is punctiform contact, wherein the punctiform contact occurs at the at least one force introduction point 30 of the operator control element 26. The at least one force introduction point 30 of the operator control element 26 is preferably formed by a contact point of the actuating surface 28 of the operator control element 26, which contact point is provided for bearing against the contact surface 32 of the actuating element 34 during an interaction of the actuating surface 28 of the operator control element 26 and the contact surface 32 of the actuating element 34 (FIGS. 3 and 4).

The operator control element 26 has the movement axis 36, in particular a pivot axis, which is arranged so as to be offset, in particular skewed, relative to a movement axis 38 of the actuating element 34. The movement axis 38 of the actuating element 34 runs preferably at least substantially parallel, in particular coaxially, with respect to a clamping axis 78 of the clamping unit 16 and/or with respect to the axis of rotation 64 of the output shaft 12. The clamping axis 78 runs preferably at least substantially parallel, in particular coaxially, with respect to the axis of rotation 64 of the output shaft 12. The operator control element 26 has the movement axis 36, wherein a straight line 40 running through the movement axis 36 of the operator control element 26 and the force introduction point 30 encloses an angle 42 in an angle range from 35° to 85°, in a plane running at least substantially perpendicular to the movement axis 36 of the operator control element 26, with the contact surface 32 of the actuating element 34 in a manner dependent on an actuation position and/or movement position of the operator control element 26 (FIGS. 3 and 4). Preferably, in an actuating position and/or movement position of the operator control element 26, in which the operator control element 26 has been moved from a rest position of the operator control element 26 (FIG. 2) into a contact position of the operator control element 26 (FIG. 3), the straight line 40 running through the movement axis 36 of the operator control element 26 and the force introduction point 30 encloses an angle 42 of less than 50° and greater than 35°, in particular an angle 42 with a value of 40°, with the contact surface 32 of the actuating element 34 (FIG. 3). In the contact position of the operator control element 26, the actuating surface 28 preferably bears against the contact surface 32, wherein the actuating element 34 has not been moved along the movement axis 38 of the actuating element 34 by the operator control element 26. Preferably, in an actuating position of the operator control element 26, in which the operator control element 26 has been moved from the rest position (FIGS. 2 and 5) or from the contact position (FIG. 3) into an end position of the operator control element 26 (FIG. 4), the straight line 40 running through the movement axis 36 of the operator control element 26 and the force introduction point 30 encloses an angle 42 of less than 90° and greater than 70°, in particular an angle 42 with a value of 80°, with the contact surface 32 of the actuating element 34. In the end position of the operator control element 26, the actuating surface 28 preferably bears against the contact surface 32, wherein the actuating element 34 has been moved along the movement axis 38 of the actuating element 34 to a maximum extent by means of the operator control element 26.

The force introduction point 30 is movable along a straight line on the contact surface 32 owing to a movement of the operator control element 26, in particular in the event of a movement of the operator control element 26 from the contact position of the operator control element 26 into the end position of the operator control element 26. The force introduction point 30 is movable along a straight line on the contact surface 32 at least substantially over a maximum extent 44 of the contact surface 32 owing to a movement of the operator control element 26, in particular in the event of a movement of the operator control element 26 from the contact position of the operator control element 26 into the end position of the operator control element 26. The operator control element 26 is mounted in pivotable fashion and has a minimum idle travel angle 46 of greater than 5°. The operator control element 26 preferably has a maximum idle travel angle 46 of less than 20°, in particular of 18°. The maximum idle travel angle 46 is an angle through which the operator control element 26 is movable during a pivoting movement of the operator control element 26 from the rest position (FIGS. 2 and 5) into the contact position (FIG. 3). The operator control element 26 has at least one stop surface 48 which limits a maximum movement, in particular a maximum travel angle, of the operator control element 26 and is arranged adjacent to the actuating surface 28 on the operator control element 26. The stop surface 48 is preferably provided to, in the end position of the operator control element 26, bear against the gearing housing 54 in order to limit a maximum movement, in particular a maximum travel angle, of the operator control element 26. The operator control element 26 has the movement axis 36, in particular a pivot axis, and has at least two operator control surfaces 50, 52 which are arranged on mutually averted sides of the operator control element 26 along a direction running at least substantially perpendicular to the movement axis 36 of the operator control element 26. One of the at least two operator control surfaces 50, 52 is provided for the exertion of a force by an operator for a movement of the operator control element 26 from the rest position (FIGS. 2 and 5) into the contact position (FIG. 3), in particular owing to a pressure force being exerted by an operator on at least one of the two operator control surfaces 50, 52. One of the at least two operator control surfaces 50, 52 is provided for the exertion of a force by an operator for a movement of the operator control element 26 from the contact position (FIG. 3) into the end position (FIG. 4), in particular owing to the exertion of a pulling force by an operator on the one of the at least two operator control surfaces 50, 52.

Figure 5:
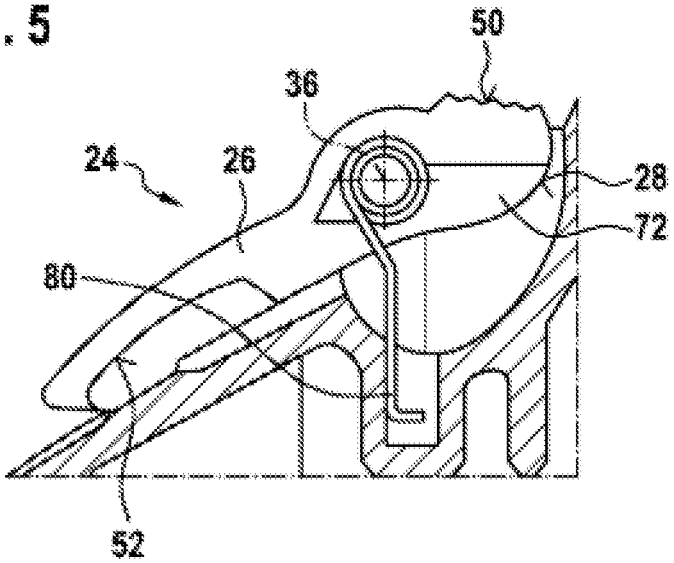
FIG. 5 shows a detail view of the operator control element, which is arranged, in a manner preloaded by means of a spring force of a spring element, on a gearing housing of the portable power tool according to the disclosure, in a schematic illustration.
Figure 6:
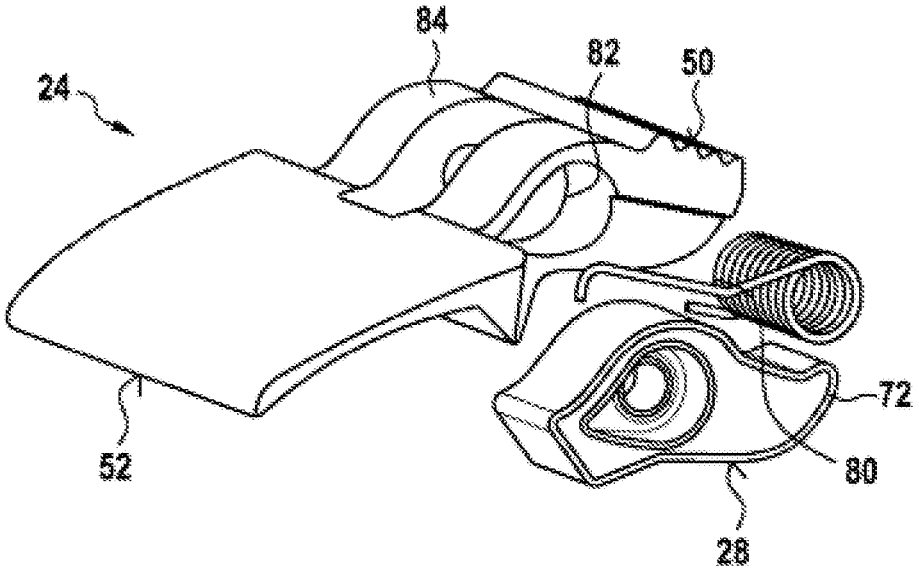
FIG. 6 shows an exploded view of the operator control element in a schematic illustration.

The operator control unit 24 comprises at least one spring element 80 which acts on the operator control element 26 with a spring force in the direction of the rest position (FIGS. 2 and 5) of the operator control element 26 (FIGS. 5 and 6). The spring element 80 is designed preferably as a torsion spring, in particular as a leg spring. The spring element 80 is supported with one end on the operator control element 26, and the spring element 80 is supported with a further end on the gearing housing 54 (FIG. 6). The spring element 80 is provided for acting on the operator control element 26 with a spring force around the movement axis 36 of the operator control element 26. The spring element 80 is preferably arranged in a region of a bearing recess 82 of the operator control element 26. The spring element 80 is provided for provisionally fixing the eccentric portion 72 of the operator control element 26 on a main body 84 of the operator control element 26 during installation of the operator control element 26. In a state of the operator control element 26 and of the spring element 80 in which these are arranged on the gearing housing 54, the spring element is provided for returning the operator control element 26 into the rest position and/or for holding the operator control element 26 in the rest position. The main body 84 is formed preferably from a plastic or from an elastomer. The eccentric portion 72 is formed preferably from a metallic material. The operator control surfaces 50, 52 are arranged on the main body 84. Furthermore, the main body 84, in the rest position (FIGS. 2 and 5), bears against the gearing housing 54. It is advantageously possible for damping of vibrations of the operator control element 26 during operation of the portable power tool 14 to be made possible.

Figure 7:
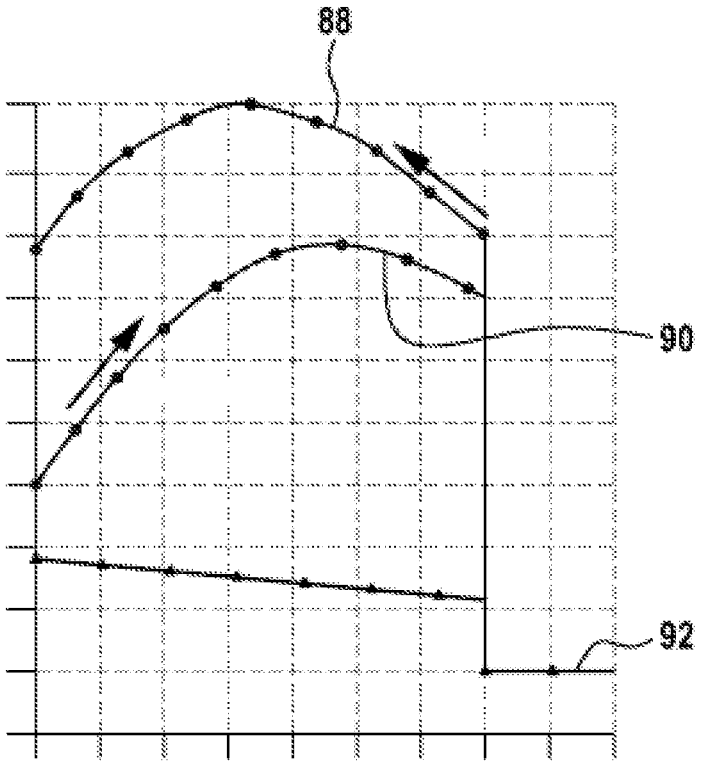
FIG. 7 shows a force diagram of an operator control element force of the operator control element in a schematic illustration.

FIG. 7 shows a force diagram of an operator control element force of the operator control element 26 in relation to a spring force of the clamping spring element 102 during a movement of the operator control element 26 around the movement axis 36 of the operator control element 26. The force diagram is depicted as a force-travel (angle) diagram in which a force is plotted versus a travel. An upper graph 88 of the force diagram shows a profile of an operator control element force of the operator control element 26 during a movement from the rest position (FIGS. 2 and 5) into the end position (FIG. 4). A middle graph 90 shows a profile of an operator control element force of the operator control element 26 during a movement from the end position (FIG. 4) into the rest position (FIGS. 2 and 5). A lower graph 92 shows a spring force profile of the clamping spring element 102 as a function of the movement of the operator control element 26.

The invention claimed is:

1. A quick clamping device for a portable power tool, comprising:

at least one output shaft configured to be driven in rotation;

at least one clamping unit including at least one movably mounted clamping element configured to exert a clamping force on an insert tool unit in a clamping position of the at least one movably mounted clamping element, the at least one clamping unit configured for fixing the insert tool unit to the at least one output shaft without use of tools; and at least one operator control unit at least configured to move the at least one movably mounted clamping element into a release position, the at least one operator control unit including at least one movably mounted operator control element a movably mounted actuating element, and at least one actuating surface, the at least one actuating surface configured for movement of the at least one movably mounted clamping element into the release position and arranged such that, during an interaction with a contact surface of the movably mounted actuating element, at least one force introduction point of the at least one movably mounted operator control element is movable on the contact surface in a manner dependent on a movement of the at least one movably mounted operator control element, wherein the at least one movably mounted operator control element has a first movement axis and includes at least two operator control surfaces arranged on mutually averted sides of the at least one movably mounted operator control element along a direction running at least substantially perpendicular to the first movement axis, and a first control surface of the at least two control surfaces is configured to cause a movement of the at least one actuating surface into contact with the contact surface as a result of a compressive force applied to the first control surface toward the contact surface.

2. The quick clamping device as claimed in claim 1, wherein the first movement axis is offset relative to a second movement axis of the movably mounted actuating element.

3. The quick clamping device of claim 2, wherein:

the first movement axis is a pivot axis; and the first movement axis is skewed relative to the second movement axis.

4. The quick clamping device as claimed in claim 1, wherein:

a straight line running through the first movement axis and the at least one force introduction point encloses, along with the contact surface of the movably mounted actuating element, an angle in an angle range from 35° to 85°, in a plane running at least substantially perpendicular to the movement axis of the at least one movably mounted operator control element, in a manner dependent on an actuation position of the at least one movably mounted operator control element.

5. The quick clamping device as claimed in claim 1, wherein the at least one force introduction point is movable along a straight line on the contact surface owing to a movement of the at least one movably mounted operator control element.

6. The quick clamping device as claimed in claim 5, wherein the at least one force introduction point is movable along the straight line at least substantially over a maximum extent of the contact surface owing to the movement of the at least one movably mounted operator control element.

7. The quick clamping device as claimed in claim 1, wherein the at least one movably mounted operator control element is pivotably mounted and has a minimum idle travel angle of greater than 5°.

8. The quick clamping device as claimed in claim 1, wherein:

the at least one movably mounted operator control element includes at least one stop surface arranged adjacent to the at least one actuating surface on the at least one movably mounted operator control element; and the at least one stop surface limits a maximum movement of the at least one movably mounted operator control element.

9. The quick clamping device of claim 8, wherein the maximum movement is a maximum travel angle.

10. The quick clamping device of claim 1, wherein the portable power tool is an angle grinder.

11. The quick clamping device of claim 1, wherein the at least one movably mounted operator control element is a movably mounted operator control lever.

12. A portable power tool, comprising:

a quick clamping device including:

at least one output shaft configured to be driven in rotation;

at least one clamping unit including at least one movably mounted clamping element configured to exert a clamping force on an insert tool unit in a clamping position of the at least one movably mounted clamping element, the at least one clamping unit configured for fixing the insert tool unit to the at least one output shaft without use of tools; and at least one operator control unit at least configured to move the at least one movably mounted clamping element into a release position, the at least one operator control unit including at least one movably mounted operator control element, a movably mounted actuating element, and at least one actuating surface, the at least one actuating surface configured for movement of the at least one movably mounted clamping element into the release position and arranged such that, during an interaction with a contact surface of the movably mounted actuating element, at least one force introduction point of the at least one movably mounted operator control element is movable on the contact surface in a manner dependent on a movement of the at least one movably mounted operator control element, wherein the at least one movably mounted operator control element has a first movement axis and includes at least two operator control surfaces arranged on mutually averted sides of the at least one movably mounted operator control element along a direction running at least substantially perpendicular to the first movement axis, and a first control surface of the at least two control surfaces is configured to cause a movement of the at least one actuating surface into contact with the contact surface as a result of a compressive force applied to the first control surface toward the contact surface.

13. The portable power tool as claimed in claim 12, further comprising:

at least one gearing housing arranged in a vicinity of at least one ventilation opening of the at least one gearing housing, wherein the at least one movably mounted operator control element is movably mounted on the at least one gearing housing, and wherein, at least in a non-actuated state, the at least one movably mounted operator control element is arranged on the at least one gearing housing so as to at least substantially not overlap the at least one ventilation opening.

14. The portable power tool as claimed in claim 12, wherein the portable power tool is an angle grinder.

* * * * *